US005094645A

United States Patent [19]

Stern et al.

[11] Patent Number: 5,094,645

[45] Date of Patent: Mar. 10, 1992

[54] APPARATUS FOR SUSPENDING A HARD OBJECT WITHIN A SOFT BODIED TOY

[75] Inventors: Howard R. Stern; Asako Ota, both of Torrance; Yasuko Harvey, Carson, all of Calif.

[73] Assignee: Mattel, Inc., El Segundo, Calif.

[21] Appl. No.: 620,783

[22] Filed: Dec. 3, 1990

[51] Int. Cl.[5] ..... A63H 3/02; A63H 3/36; A63H 11/00

[52] U.S. Cl. ..... 446/370; 446/373; 446/353

[58] Field of Search ..... 446/369, 370, 371, 372, 446/373, 374, 375, 390, 391, 394, 395, 330, 352, 353, 354, 355, 356, 357, 358

[56] References Cited

U.S. PATENT DOCUMENTS

| | | | |
|---|---|---|---|
| 1,402,345 | 1/1922 | Felkner | 446/370 |
| 2,347,405 | 4/1944 | Ford | 446/369 |
| 3,029,552 | 4/1962 | Katz | 446/370 X |
| 4,763,369 | 8/1988 | Spector | 446/369 X |
| 4,822,285 | 4/1989 | Summerville | 446/369 X |
| 4,878,871 | 11/1989 | Noto | 446/302 |

FOREIGN PATENT DOCUMENTS

| | | | |
|---|---|---|---|
| 2119264 | 11/1983 | United Kingdom | 446/353 |

*Primary Examiner*—David N. Muir

[57] ABSTRACT

A soft bodied toy including an outer layer of material, an inner layer of material, a relatively dense object positioned within the inner and outer layers, apparatus fixing the outer and inner layers together to provide a space therebetween, stuffing material placed in the space to provide a soft cushion, the inner layer being of a form to provide a cavity for the hard inner mechanism, and apparatus for holding the mechanism firmly within the inner layer.

10 Claims, 2 Drawing Sheets

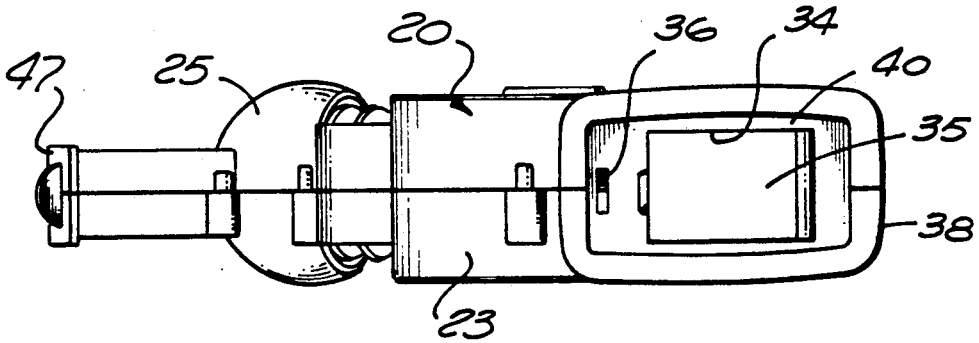
FIG. 3
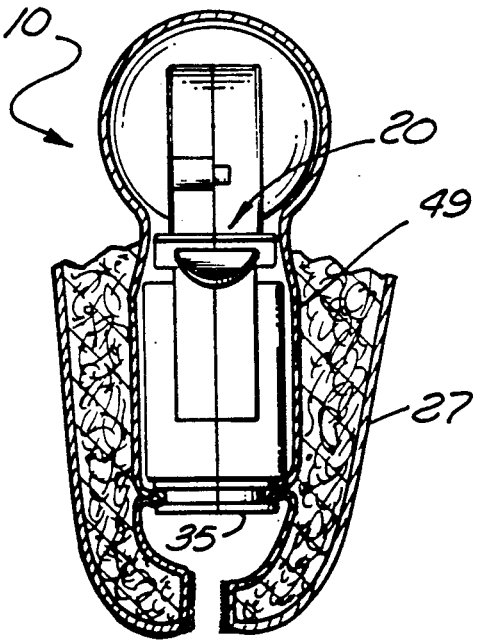
FIG.4
FIG. 5
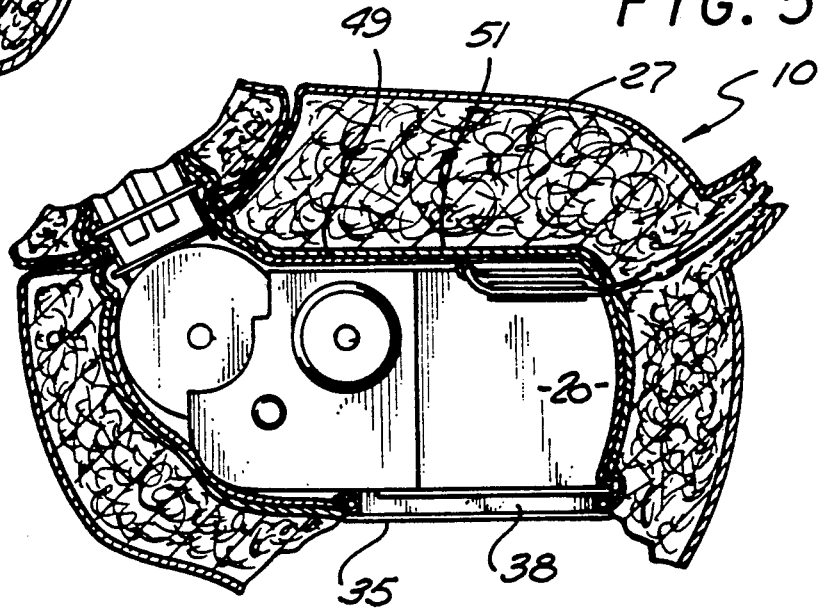

APPARATUS FOR SUSPENDING A HARD OBJECT WITHIN A SOFT BODIED TOY

BACKGROUND OF THE INVENTION

1. Field of the Invention

This invention relates to toys and, more particularly, to apparatus for suspending a hard object within a soft bodied toy.

2. History of the Prior Art

Historically, toys which represent living creatures have been divided into two classes, hard bodied and soft bodied toys. Soft bodied toys may be easily designed to represent animals because the various plush materials available provide an easy way to represent animal coats. Plush toys provide a much more realistic appearance for animals than do hard bodied toys. Hard bodied toys, on the other hand, provide the support necessary for mechanical mechanisms which may be made to carry out various of the functions normally (or abnormally) performed by the creatures represented. Thus, a hard bodied toy may be easily provided with a mechanism for producing sound so that the toy may appear to speak or make animal noises. This ability to provide animal functions within a hard bodied toy also makes the toy seem more realistic.

In an attempt to make toys even more realistic, attempts have been made to combine these two types of toys. In general, hard bodied toys have been given outer skins of plush material to stimulate the skin of the animal. However, the toy remains a hard bodied toy, and does not have the soft pillowy feel of a soft bodied toy. Consequently, it is difficult to make these toys appeal to very small children who apparently realize that the toy is an unfamiliar mechanism rather than the cuddly animal it attempts to represent. When attempts have been made to suspend solid mechanisms within a soft bodied toy, the hard mechanism has a tendency to find its way to lie just below the surface of the soft material so that it is very apparent that a mechanism resides inside.

SUMMARY OF THE INVENTION

It is, therefore, an object of the present invention to provide a soft bodied toy capable of holding within its body cavity a hard mechanism in a manner such that the presence of the mechanism is not obvious to a child.

It is another more specific object of the present invention to provide a toy having a soft body and a hard internal mechanism which may be easily manufactured.

These and other objects of the present invention are realized in a soft bodied toy comprising an outer layer of material, an inner layer of material, a relatively dense object positioned within the inner and outer layers, means fixing the outer and inner layers together to provide a space therebetween, stuffing material placed in the space to provide a soft cushion, the inner layer being of a form to provide a cavity for the hard inner mechanism, and means for holding the mechanism firmly within the inner layer.

These and other objects and features of the invention will be better understood by reference to the detailed description which follows taken together with the drawings in which like elements are referred to by like designations throughout the several views.

BRIEF DESCRIPTION OF THE DRAWINGS

FIG. 3 is a bottom view of a portion of the toy illustrated in FIG. 1.

FIG. 4 is a front view of a portion of the toy illustrated in FIG. 1.

FIG. 5 illustrates details of the arrangement for accomplishing the invention.

DETAILED DESCRIPTION OF THE INVENTION

Figure 1:
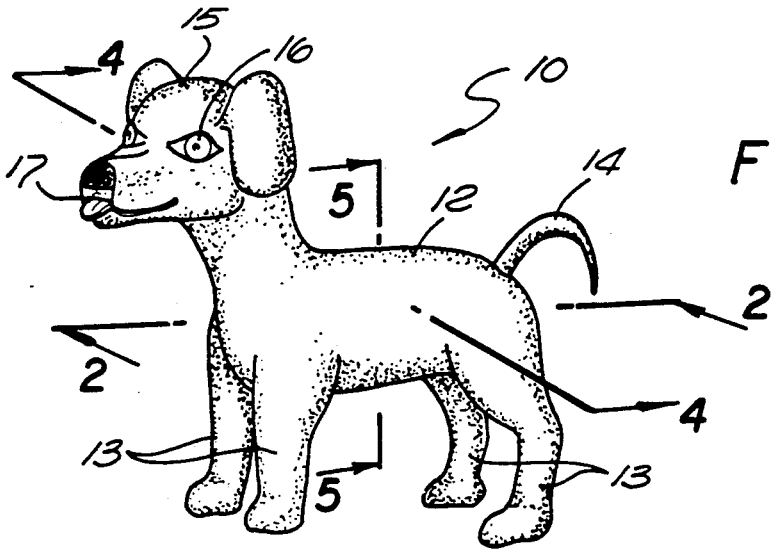
FIG. 1 is a an isometric view of a toy constructed in accordance with the invention.

Referring now to FIG. 1, there is illustrated an isometric view of a toy 10 constructed in accordance with the invention. The toy 10 represents a dog although any of number of other animals might be represented. The toy 10 has a body 12, legs 13 attached to the body 12, a tail 14 also attached to the body 12, and a head 15 mounted upon the body 12. The head 15 positions two eyes 16 and a mouth 17. Other details of the exterior may be seen from the figure but are unimportant to the invention and for that reason are not mentioned in this description.

The entire exterior surface of the toy 10, except for trivial areas such as the surface of the eyes 16 and the mouth 17, is covered with a soft plush material of a color or colors such as to represent the color of a dog. Consequently, the toy 10 may be made to resemble a dog very closely. Within the exterior of the body 12 of the toy 10 is contained a thick layer of soft stuffing material of a type usually used for stuffing soft bodied toys. Supported within the stuffing material in accordance with this invention is a mechanism used to provide some realistic characteristic of a dog. In a preferred embodiment of the invention, the mechanism is adapted to cause the head 15 to move up and down and a tongue to move in and out of the mouth 17. As will be explained hereinafter, the manner in which the stuffing is accomplished makes the toy 10 feel as though it were a soft bodied toy even though a heavy mechanism is suspended inside.

Figure 2:
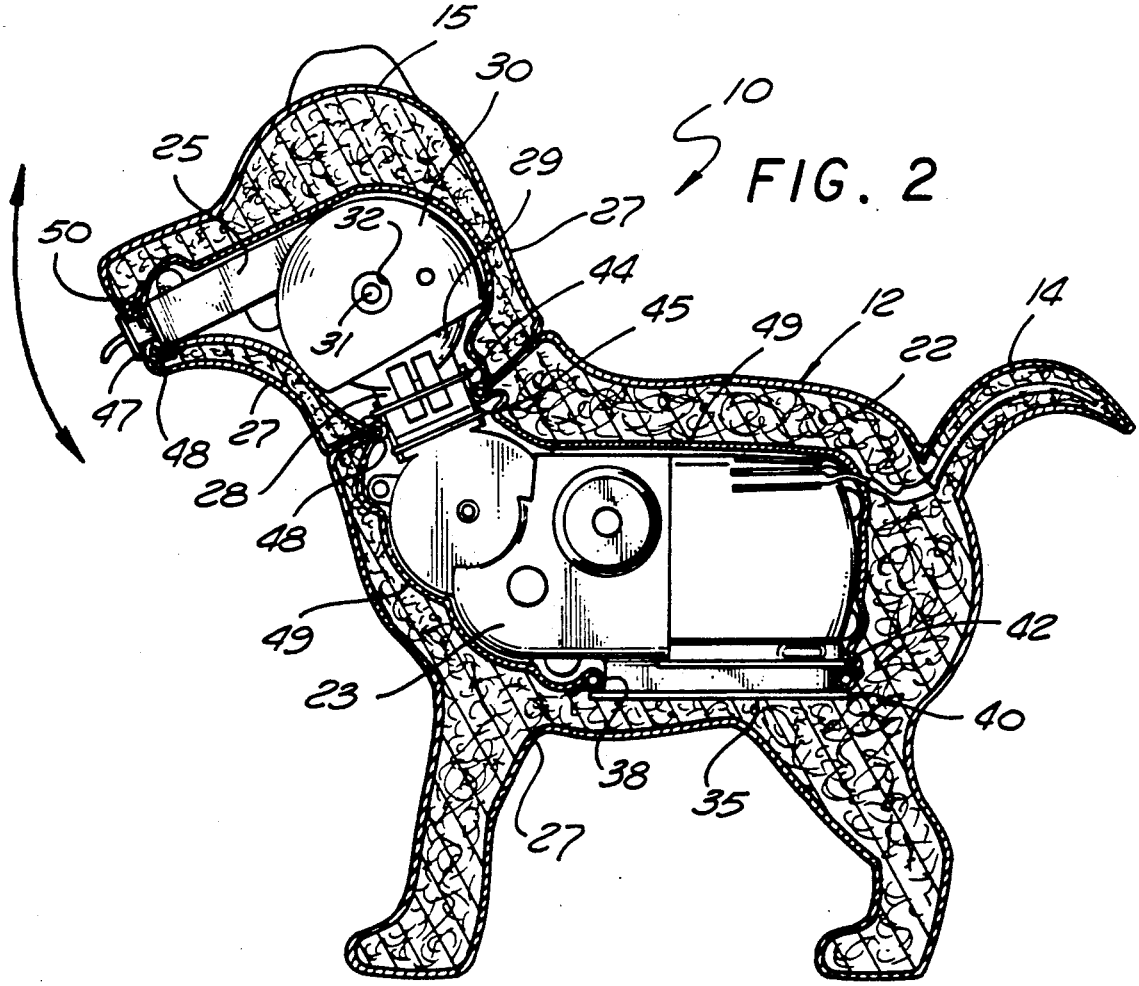
FIG. 2 is a cross-sectional view of the interior of the toy taken along the line 2—2 of FIG. 1.

FIG. 2 is a cross-sectional view of the interior of the toy 10 taken along the line 2—2 of FIG. 1. Shown in FIG. 2 are the head 15 and the body 12 of the toy 10. Positioned within the body 12 and the head 15 is illustrated a mechanism 20 adapted to produce the motion of the head 15 referred to above. The mechanism 20 is surrounded within the body 12 by soft stuffing material 22. The particular motion is one which is especially difficult to produce while maintaining the mechanism 20 in position within the body 12 so that a child will feel only the soft material surrounding the mechanism 20. The motion is difficult to produce because the mechanism must be very firmly positioned in order to be able to move the head 15 back and forth while the body remains still. It will be appreciated, however, that the arrangement of this invention by which the mechanism 20 is positioned within the body 12 is useful for positioning a hard mechanism within a soft body of a toy whether the mechanism be for producing this particular motion or some other motion. For example, the body 12 might be so positioned while a leg or a tail of the animal might be caused to move in accordance with the invention. In the simplest case, the mechanism 20 is positioned within the body without any movement of an appendage at all.

As may be seen in FIG. 2, the mechanism 20 includes a first portion 23 which is generally rectangular in cross section mounted within the body 12 and a second portion 25 mounted within the head 15. Also, it may be discerned from FIG. 2 that the head 15 and the body 12 are not separated as is the case with many soft bodied toys. In fact, the head 15 and the body 12 are formed with one continuous exterior 27 made of plush material in the preferred embodiment. The portion 23 of the mechanism has an extending portion 28 which projects upwardly and forms the interior of the neck of the toy 10. The extending portion 28 terminates in a generally-spherical end portion 29. The second portion 25 is shaped to fit the interior of the head 15 and has a portion 30 with a generally-spherical interior to fit over the end portion 28. Extending from the end portion 28 are short cylindrical pegs 31. The pegs 31 are adapted to fit within circular holes 32 in the portion 25 so that the portion 25 may pivot back and forth about the pegs in the direction shown by the arrow in FIG. 2.

The portion 23 of the mechanism 20 includes the mechanical or other devices for causing the movement of the portion 25 explained above. Since the particular mechanism forms no part of this invention, the details of that device are not included in this specification except that the head 15 pivots in the manner illustrated. However, it should be understood that the mechanism 20 may be quite dense compared to the other portions of the toy 10 because of the weight of the internal portions of the mechanism 20. In a particular toy 10, the mechanism 20 has an outer shell constructed of a hard moldable plastic material such as styrene which contains the inner mechanism (not shown).

In order to operate a mechanism such as the mechanism 20, it is usually necessary to utilize storage batteries or a mechanical wind-up arrangement. To this end, the mechanism 20 includes an opening 34 covered by a door 35 in the lower surface of the portion 23 as may be seen in FIG. 3. FIG. 3 is a bottom view of the mechanism 20. The door 35 maybe used to access the mechanism to replace batteries or to wind a mechanical mechanism. A switch 36 is illustrated adjacent the door 35 for actuating the mechanism 20; the preferred embodiment of the toy 10 uses an electrical mechanism 20, and the switch 36 turns on that mechanism. Surrounding the door 35 and the switch 36 is a downwardly extending ridge 38 which is flanged outwardly from the opening 34 at its extremity. Spaced from and paralleling the extreme flange 40 is a second flange 42 which projects from the ridge 38. The two flanges 40 and 42 form a channel surrounding the ridge 38 which is utilized to support the mechanism 20 within the toy 10. Another pair of flanges 44 and 45 surround the center of the extending portion 28 to form a second channel. A flange 47 is positioned at the extreme end of the portion 25 adjacent the mouth of the toy 10. The end of the portion 25 adjacent the flange 47 is shaped to provide a third channel for supporting the mechanism 20.

In order to provide the support for the mechanism 20 to hold it suspended within the soft body 12 and head 15, the exterior 27 and an inner layer of fabric 49 are sewn together to form an outer shell which surrounds the mechanism 20. The inner layer of fabric is sewn or formed into a shape such that it is adapted to fit snugly around the exterior of the mechanism 20. The shape of the inner layer 49 will, therefore, depend on the shape of the mechanism 20. It should be noted (see FIG. 5) that the shape of the inner layer 49 need only generally approximate the shape of the mechanism 20 because of the arrangement for securing the mechanism 20 to the inner layer to be described hereinafter. Consequently, if the inner layer is sewn, the seams may be made to be sewn on relatively straight lines and the amount of sewing minimized to provide rapid and economic assembly. Alternatively, the inner layer may be formed of a material such as a thin malleable plastic adapted to fit relatively tightly about the mechanism 20 so that the layer 49 itself acts as the means for securing the layer 49 to the mechanism 20.

The exterior 27 and the inner layer of fabric 49 may be joined at the mouth of the toy 10 and by webs or other pieces of material sewn or otherwise secured to maintain a generally fixed thickness for the space within the layers surrounding the mechanism. Thus, the layer 49 and the exterior 27 form a shell around the mechanism 20. Hollow tubes 48 are sewn into the inner layer of 49 adjacent the channels on the mechanism at the mouth, the neck, and at the door 35. Strings or plastic ties 50 are inserted in these tubes 48; and the tubes 48 in the inner layer are drawn tightly into the first, second, and third channels in the mechanism 20. The exterior 27 of the toy is left open at some point such as the rear of the toy 10 so that the shell or bag formed by the exterior 27 and the inner layer of fabric 49 may be stuffed after particular ones of the ties 50 have been secured to the mechanism 20. Thus, for example, the inner layer 49 may be fastened to the mouth of the toy 10 at the channel of the mechanism 20 adjacent the mouth of the toy 10; and a portion of the head stuffed. Then the layer 49 may be joined by a tie 50 at the channel at the neck and the remainder of the head 15 stuffed. The stuffing process may continue to fill most of the body 12. Then the tie to the channel surrounding the door 35 may be made; and the remainder of the toy 10 stuffed and closed.

FIG. 4 is a cross-sectional view taken along line 4—4 in FIG. 1 which illustrates that the shell made of the exterior 27 and the inner layer 49 may be extended beyond the door 35 and closed with a closure 55 device such as Velcro(R) or a zipper so that no portion of the mechanism 20 apart from that at the mouth of the toy 10 may be felt or viewed by a child from the exterior. FIG. 6 also shows that by stuffing the shell formed by the exterior 27 and the inner layer 49 tightly, there is no tendency for the mechanism to move within the soft bag. Consequently, the mechanism 2 will remain positioned within the central portion of the toy 10 so that the toy 10 will appear to be a soft toy throughout.

In a preferred embodiment of the invention, a second inner layer of fabric 51 of just larger than the size of the layer of fabric 49 is constructed and placed within the shell formed by the inner layer 49 and the exterior 27. The layer of fabric 51 becomes one side of the shell which is stuffed. The layer 51 is joined as by sewing to the layer of fabric 49 along the back of the toy 10. The layer 49 is joined to the mechanism 20 by ties as explained above. Then the mechanism surrounded by the layer 49 may be inserted into the pocket formed in the shell within the layer 51. The shell may be partially stuffed (e.g., at the head) before the insertion. As the stuffing continues to completion, the layer 49 may be sewn at a few points along the front and rear to secure the layer 49 firmly to the layer 51 so that the mechanism is firmly fixed within the soft body. By the process, the assembly of the toy 10 may be completed more expeditiously.

Although the layer 49 may be sewn to the layer 51 to assist in securing it in position, the major positioning in the preferred embodiment of the invention by which the hard mechanism 20 is supported within the soft body is the pair of tubes mating with the channels which fix the layer 49 in two planes to a portion of the mechanism which is to be suspended. Thus the channels into which the tubes of the layer 49 are firmly fixed provide a pair of fixed planes at which the outer soft portion of the body 12 is joined to the body portion of the hard mechanism 20. In a like manner, the soft outer head portion is joined to the head portion of the hard mechanism 20 at a pair of planes formed by the channels at the mouth and neck. With these two planes of the soft outer body affixed to the hard portion inside, when the soft body is stuffed the hard inner portion is isolated from the exterior of the toy. Thus, whenever a portion of a soft toy is to move relative to some other portion, this may be accomplished by fixing each of the portions to its exterior at a pair of planes. In a case in which a relatively small portion such as a tail is to move with respect to a relatively larger portion such as the body, one of the two planes may be replaced by a single point to which the exterior may be firmly fixed (e.g., the end of the tail).

Although the present invention has been described in terms of a preferred embodiment, it will be appreciated that various modifications and alterations might be made by those skilled in the art without departing from the spirit and scope of the invention. The invention should therefore be measured in terms of the claims which follow.

What is claimed is:

1. A soft bodied toy comprising an outer layer of material, an inner layer of material, a relatively dense object positioned within the layer and outer layers, means fixing the outer and inner layers together to provide a space therebetween, said dense object including a mechanism to animate at least a portion of said toy stuffing material placed in the space to provide a soft cushion essentially surrounding the relatively dense object, the inner layer being of a form to provide a cavity for the relatively dense object, and means for holding the relatively dense object firmly within the inner layer so that its existence is not obvious from the exterior of the toy, said means for holding comprising multiple securing means engaging said dense object which are operatively connected to said outer layer through said stuffing, wherein said securing means may comprise tubes.

2. A soft bodied toy as claimed in claim 1 in which the means for holding the relatively dense object firmly within the inner layer comprises means for fixing the inner layer of material to the relatively dense object at a pair of planes.

3. A soft bodied toy as claimed in claim 2 in which the means for fixing the inner layer of material to the relatively dense object at a pair of planes comprises a channel surrounding the dense object at each of the pair of planes, and means for fixing the inner layer of material to the channels.

4. A soft bodied toy as claimed in claim 1 in which the means for fixing the inner layer of material to the channels comprises tubes sewn in the inner layer of material, and means for tightening each tube to fit into a channel.

5. A soft bodied toy as claimed in claim 4 further comprising means for opening the inner and outer layers of material to allow access to the relatively dense object.

6. A soft bodied toy as claimed in claim 1 in which the relatively dense object positioned within the inner and outer layers comprises first and second portions adapted to move with respect to each other, and the means for holding the relatively dense object firmly within the inner layer comprises means for holding each portion of the relatively dense object firmly within the inner layer.

7. A soft bodied toy as claimed in claim 6 in which the means for holding the relatively dense object firmly within the inner layer comprises means fixing the inner layer of material to each portion of the relatively dense object at a pair of planes.

8. A soft bodied toy as claimed in claim 7 in which the means for fixing the inner layer of material to each portion of the relatively dense object at a pair of planes comprises a pair of channels, one channel surrounding each of the portions of the relatively dense object at each of the pair of planes, and means for fixing the inner layer of material to the channels.

9. A soft bodied toy as claimed in claim 8 in which the means for fixing the inner layer of material to the channels comprises tubes sewn in the inner layer of material, and means for tightening each tube to fit into a channel.

10. A soft bodied toy as claimed in claim 9 further comprising means for opening the inner and outer layers of material to allow access to the relatively dense object.

* * * * *